US012054233B2

(12) United States Patent
Lin et al.

(10) Patent No.: US 12,054,233 B2
(45) Date of Patent: Aug. 6, 2024

(54) PEDAL INSTALLATION STRUCTURE OF BOAT

(71) Applicant: Fujian Doofar Outdoor Sporting Goods Co., Ltd., Longyan (CN)

(72) Inventors: Xizhen Lin, Longyan (CN); Junpeng Yan, Longyan (CN); Yongjiang Liu, Longyan (CN)

( * ) Notice: Subject to any disclaimer, the term of this patent is extended or adjusted under 35 U.S.C. 154(b) by 385 days.

(21) Appl. No.: 17/696,830

(22) Filed: Mar. 16, 2022

(65) Prior Publication Data

US 2023/0202639 A1 Jun. 29, 2023

(30) Foreign Application Priority Data

Dec. 29, 2021 (CN) ..... 202123367879.8

(51) Int. Cl.
*B63H 25/02* (2006.01)
*B63H 25/10* (2006.01)

(52) U.S. Cl.
CPC ..... *B63H 25/02* (2013.01); *B63H 25/10* (2013.01)

(58) Field of Classification Search
CPC ..... B63H 25/00; B63H 25/02; B63H 25/10
USPC ..... 114/153
See application file for complete search history.

(56) References Cited

U.S. PATENT DOCUMENTS

| | | | | |
|---|---|---|---|---|
| 8,100,075 | B2 * | 1/2012 | Wang | B63H 25/10 114/153 |
| 8,753,156 | B2 * | 6/2014 | Ketterman | B63H 25/42 440/26 |
| 11,312,465 | B2 * | 4/2022 | Zhang | B63H 25/10 |

* cited by examiner

*Primary Examiner* — Lars A Olson

(57) ABSTRACT

A pedal installation structure of a boat includes a slide rail, a pull rod, a slider, and a pedal. The slide rail has a plurality of spaced tooth grooves thereon. The pedal is installed on the slider. The slider is slidably installed on the slide rail. The pull rod is installed between the slider and the slide rail. One end of the slider is provided with a rotatable pawl. A lower surface of the pawl is provided with a plurality of spaced teeth. It is convenient to use the pedal that has a simple structure.

20 Claims, 8 Drawing Sheets

PEDAL INSTALLATION STRUCTURE OF BOAT

BACKGROUND OF THE INVENTION

1. Field of the Invention

The present invention relates to a pedal, and more particularly to a pedal installation structure of a boat.

2. Description of the Prior Art

The hull of a conventional kayak is usually composed of the bow of the hull, the middle of the hull and the stern of the hull. The power source is usually a motor located at the stern. In general, the conventional kayak is equipped with pedals.

The pedal of the conventional kayak can be moved along a slide rail to adjust the position of the pedal, so as to meet the needs of the driver. The pedal is restricted at a restricting position on the slide rail through a restricting member. When the pedal needs to be moved, it is necessary to pull out the restricting member from the restricting position, and then hook the pedal with the driver's foot for the pedal to move along the slide rail. When the pedal is moved to the desired position, the restricting member is inserted at another corresponding restricting position to secure the pedal. There is a disadvantage of being troublesome to use.

SUMMARY OF THE INVENTION

The primary object of the present invention is to provide a pedal installation structure of a boat, which has a simple structure and is convenient to use.

In order to achieve the above object, the present invention adopts the following technical solutions:

A pedal installation structure of a boat comprises a slide rail, a pull rod, a slider, and a pedal. The slide rail has a plurality of spaced tooth grooves thereon. The pedal is installed on the slider. The slider is slidably installed on the slide rail. The pull rod is installed between the slider and the slide rail. One end of the slider is provided with a rotatable pawl. A lower surface of the pawl is provided with a plurality of spaced teeth. When a first end of the pull rod is pushed, an opposing second end of the pull rod pushes up the pawl, so that the teeth are disengaged from the tooth grooves for the slider to move on the slide rail in a first direction. When the pull rod is released, the pawl falls so that the teeth are engaged in the corresponding tooth grooves. When the pull rod or the pedal is pulled, the slider is driven to move on the slide rail in a second direction opposite to the first direction, and the teeth are each disengaged from a corresponding one of the tooth grooves and then engaged in an adjacent one of the tooth grooves.

Preferably, one side wall of each tooth groove is defined as a first inclined surface that is flared. One side surface of each tooth is defined as a second inclined surface. The first inclined surface is configured to be in close contact with the second inclined surface. Another side wall of each tooth groove is defined as a blocking surface. The blocking surface is opposite to the first inclined surface.

Preferably, the second end of the pull rod is formed with an inclined top surface, and the inclined top surface is attached to an inner side surface of the pawl.

Preferably, the pedal installation structure of the boat further comprises a pivot shaft and a torsion spring. The torsion spring is sleeved on the pivot shaft. The pivot shaft passes through the end of the slider and the pawl. One end of the torsion spring is connected to the slider. Another end of the torsion spring is connected to the pawl. When the pull rod is pushed, the second end of the pull rod pushes up the pawl, and the torsion spring is elastically deformed. When the pull rod is released, the torsion spring is elastically restored and the pawl falls.

Preferably, the slider is provided with a pedal seat. A middle portion of the pedal seat is provided with a shaft. A lower end of a rudder wheel is insertedly connected to the shaft. The pedal is insertedly connected to the shaft. The rudder wheel is located between the pedal and the pedal seat. The pedal is detachably connected to the rudder wheel. An upper end of the rudder wheel is formed with a first rope-winding chamber. The pedal seat is formed with a second rope-winding chamber. The shaft is located in the middle of the second rope-winding chamber. One end of a rudder connecting rope is connected to one end of the slide rail away from the pull rod. The rudder connecting rope is wound in the second rope-winding chamber and the first rope-winding chamber in sequence. Another end of the rudder connecting rope is connected to a rudder of the boat.

Preferably, a rotating wheel for winding the rudder connecting rope is provided in the first rope-winding chamber. The first rope-winding chamber is provided with a plurality of spaced restricting plates extending outwardly. The restricting plates surround the rotating wheel. The restricting plates are spaced apart from the rotating wheel.

Preferably, the pedal installation structure of the boat further comprises an elastic rope. One end of the elastic rope is connected to the upper end of the rudder wheel, and another end of the elastic rope is connected to the slider.

Preferably, the pedal is connected to the rudder wheel through cooperation of a protrusion and a groove. The slider is provided with a pedal seat. A middle portion of the pedal seat is provided with a shaft. The pedal is insertedly connected to the shaft. The pull rod has a raised block close to the second end of the pull rod. A downward bent portion is formed on one side of the pawl away from the teeth. The raised block is located between an outer side wall of the pedal seat and the downward bent portion.

Alternatively, the slider is provided with a pedal seat. A middle portion of the pedal seat is provided with a shaft. The pedal is insertedly connected to the shaft. The pedal is connected to the pedal seat through cooperation of a protrusion and a groove.

By adopting the above technical solutions, through the structural design of the pull rod, the slide rail and the slider of the present invention, the pull rod is disposed between the slider and the slide rail. The slider is provided with the pawl having the teeth. The slide rail is formed with the tooth grooves for the teeth to be engaged in. When in use, the user can push the first end of the pull rod for the second end of the pull rod to push up the pawl, so that the teeth are disengaged from the tooth grooves for the slider to move on the slide rail in the first direction. When the pull rod is released, the pawl falls and the teeth are engaged in the corresponding tooth grooves, such that the slider is positioned at the desired position on the slide rail. When the pull rod or the pedal is pulled, the slider is driven to move on the slide rail in the second direction opposite to the first direction, the teeth are each disengaged from one of the tooth grooves and then engaged in an adjacent one of the tooth grooves, such that the slider is positioned at the desired position on the slide rai. The slider can move forward and backward along the slide rail. It is convenient to use the pedal that has a simple structure.

DETAILED DESCRIPTION OF THE PREFERRED EMBODIMENTS

Figure 1:
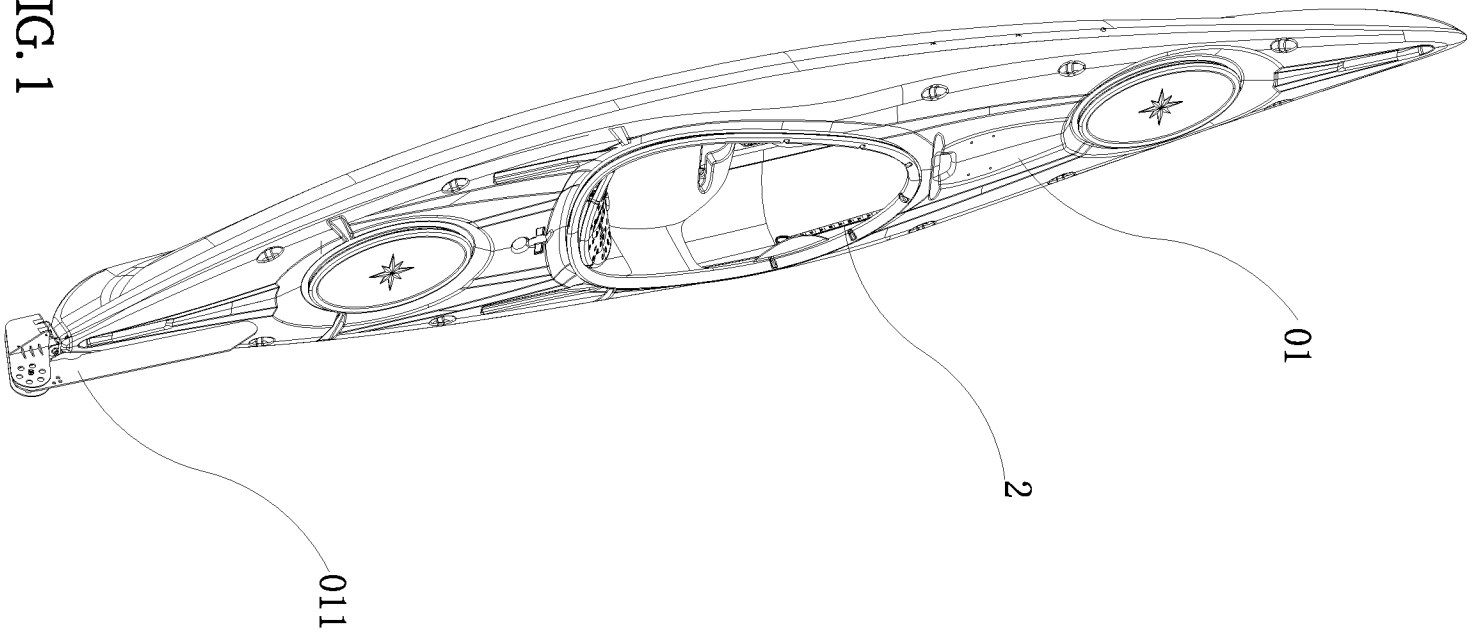
FIG. 1 is a schematic view of a first embodiment of the present invention when in use.

Embodiments of the present invention will now be described, by way of example only, with reference to the accompanying drawings.

As shown in FIG. 1 through FIG. 6, the present invention discloses a pedal installation structure of a boat, comprising a slide rail 1, a pull rod 2, a slider 3 and a pedal 4. The slide rail 1 has a plurality of spaced tooth grooves 11 thereon. The pedal 4 is installed on the slider 3. The slider 3 is slidably installed on the slide rail 1. The pull rod 2 is installed between the slider 3 and the slide rail 1. One end of the slider 3 is provided with a rotatable pawl 5. The lower surface of the pawl 5 is provided with a plurality of spaced teeth 51. When a first end of the pull rod 2 is pushed, an opposing second end of the pull rod 2 pushes up the pawl 5, so that the teeth 51 are disengaged from the tooth grooves 11 for the slider 3 to move on the slide rail 1 in a first direction. When the pull rod 2 is released, the pawl 5 falls so that the teeth 51 are engaged in the corresponding tooth grooves 11. When the pull rod 2 or the pedal 4 is pulled, the slider 3 is driven to move on the slide rail 1 in a second direction opposite to the first direction, and the teeth 51 are each disengaged from a corresponding one of the tooth grooves 11 and then engaged in an adjacent one of the tooth grooves 11. In order to facilitate the driver to hold the pull rod 2, a holding hole 22 is formed at the first end of the pull rod 2.

Figure 2:
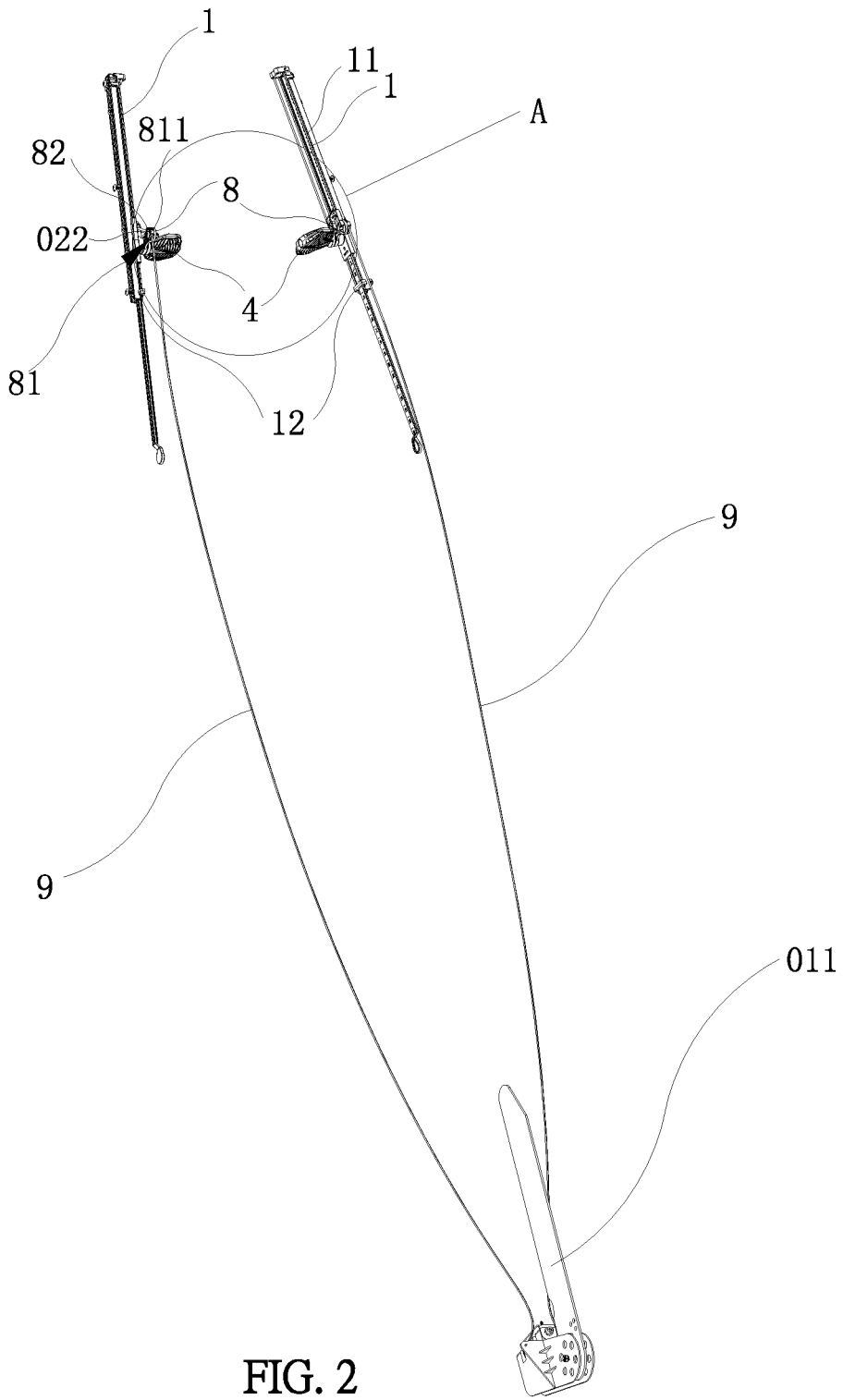
FIG. 2 is a partial schematic view of the first embodiment of the present invention when in use.
Figure 2A:
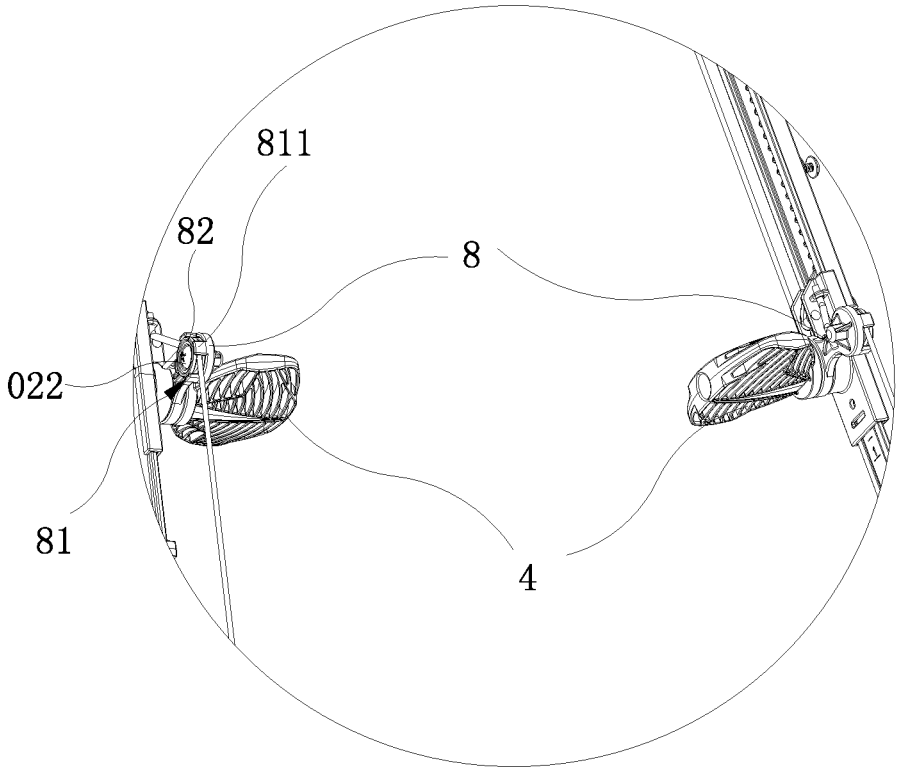
FIG. 2A is an enlarged view of circle A of FIG. 2.
Figure 3:
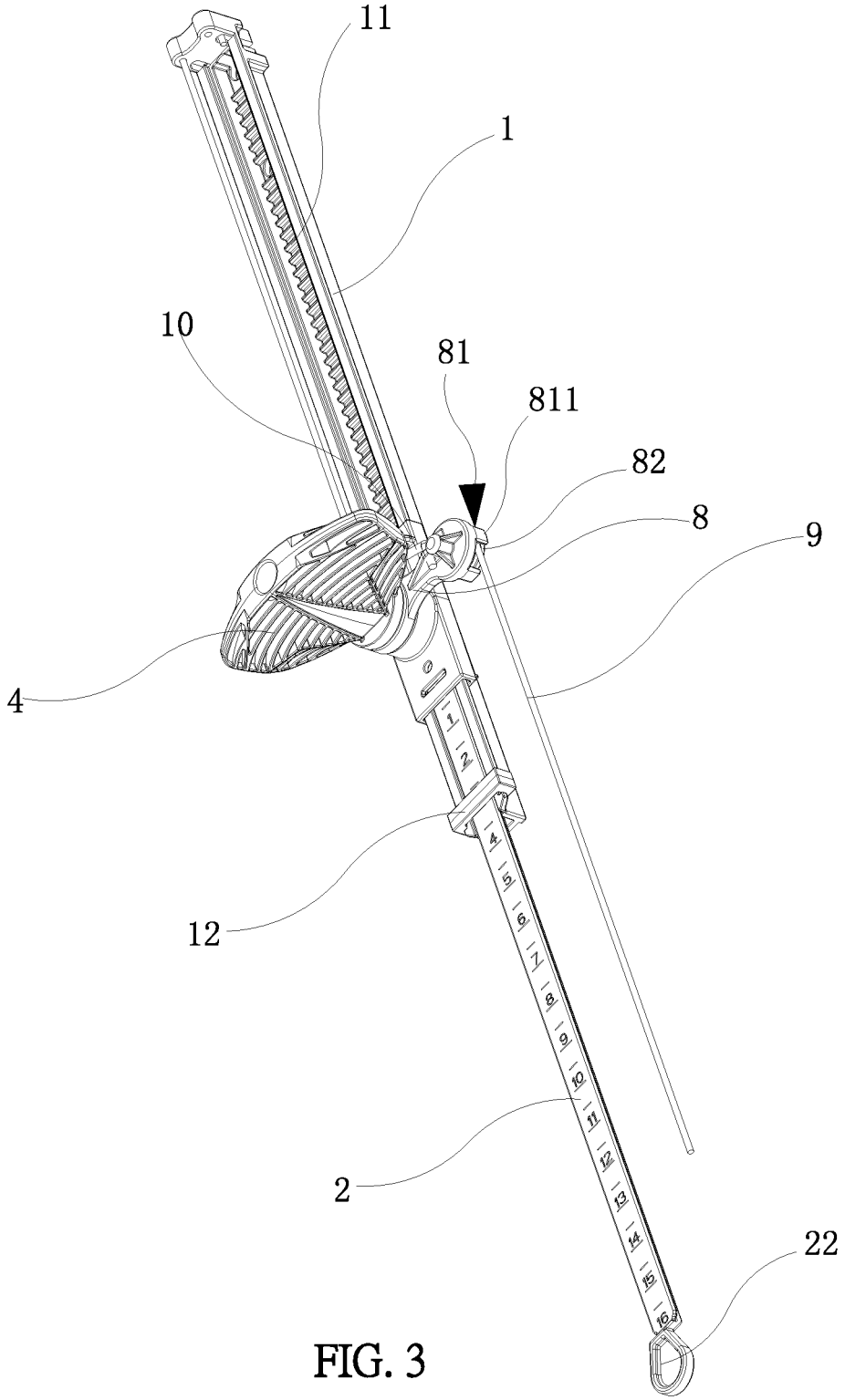
FIG. 3 is a partial perspective view of the first embodiment of the present invention.
Figure 4:
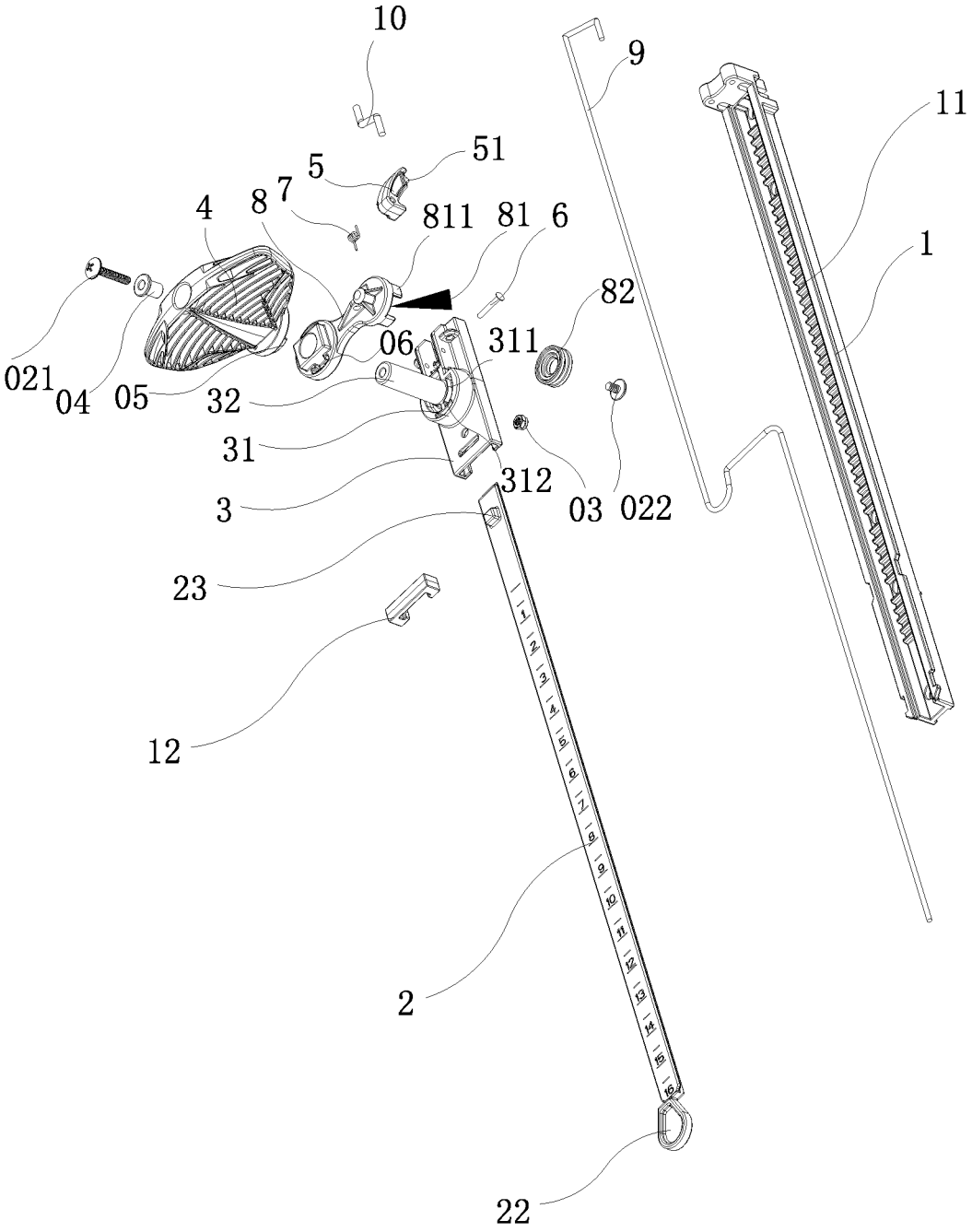
FIG. 4 is an exploded view of FIG. 3.
Figure 5:
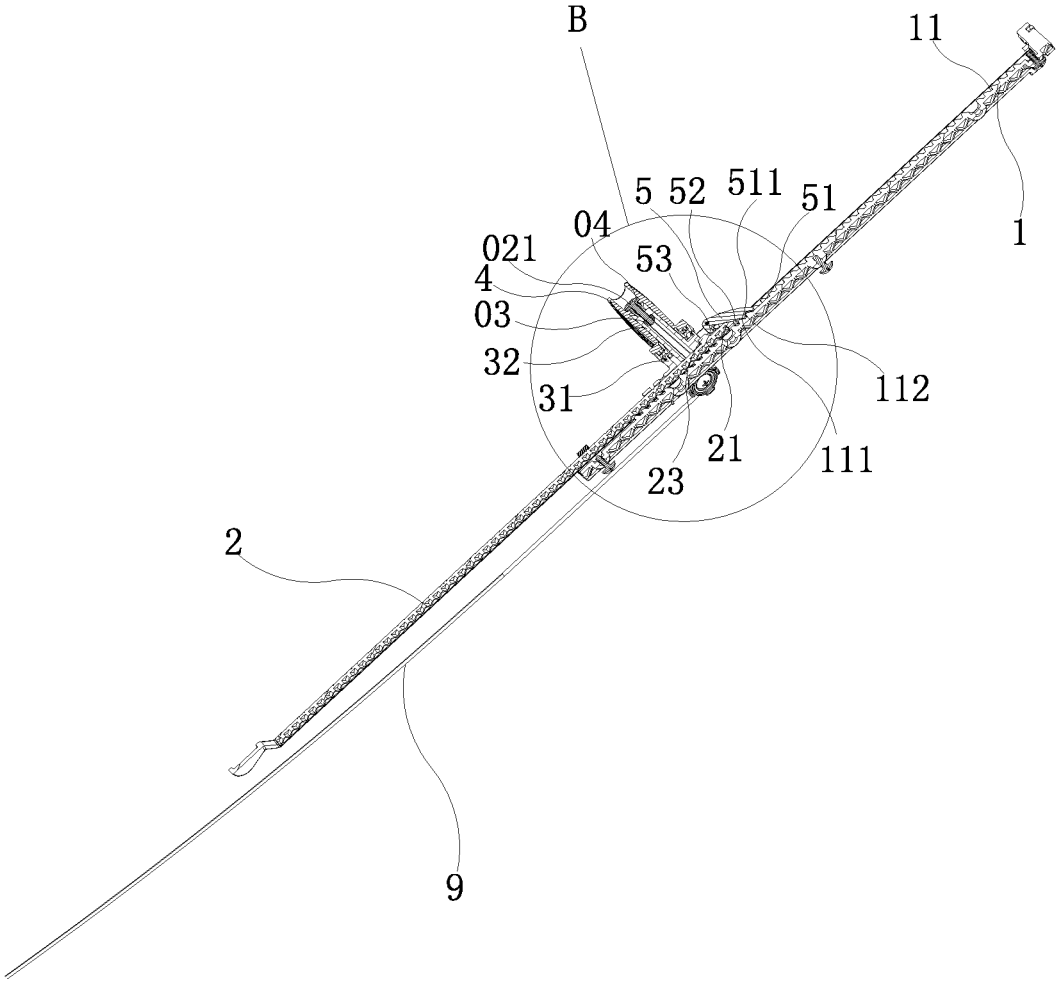
FIG. 5 is a cross-sectional view of FIG. 3.
Figure 5B:
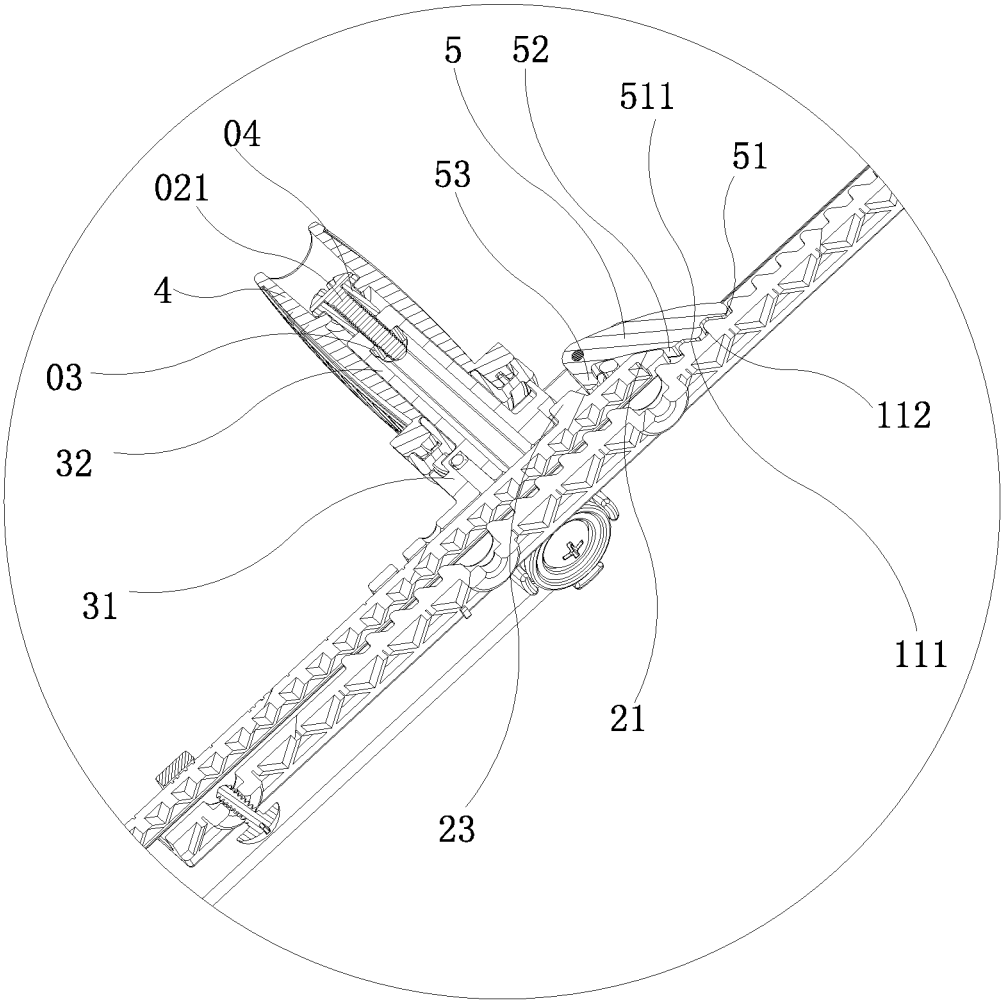
FIG. 5B is an enlarged view of circle B of FIG. 5.

Therefore, through the structural design of the pull rod 2, the slide rail 1 and the slider 3 of the present invention, the pull rod 2 is disposed between the slider 3 and the slide rail 1. The slider 3 is provided with the pawl 5 having the teeth 51. The slide rail 1 is formed with the tooth grooves 11 for the teeth 51 to be engaged in. When in use, the user can push the first end of the pull rod 2 for the second end of the pull rod 2 to push up the pawl 5, so that the teeth 51 are disengaged from the tooth grooves 11 for the slider 3 to move on the slide rail 1 in the first direction. When the pull rod 2 is released, the pawl 5 falls and the teeth 51 are engaged in the corresponding tooth grooves 11, such that the slider 3 is positioned at the desired position on the slide rail 1. When the pull rod 2 or the pedal 4 is pulled, the slider 3 is driven to move on the slide rail 1 in the second direction opposite to the first direction, each of the teeth 51 is disengaged from one of the tooth grooves 11 and then engaged in an adjacent one of the tooth grooves 11, such that the slider 3 is positioned at the desired position on the slide rail 1. The slider 3 can move forward and backward along the slide rail 1. It is convenient to use the pedal that has a simple structure. In addition, the pedal 4 of the present invention may be used as a left pedal and a right pedal. There is no need to separately mold the left and right pedals, saving production costs. As shown in FIG. 2, when in use, two pedal installation structures of the present invention are provided. The pedal 4 of one pedal installation structure is used as the left pedal, and the pedal 4 of the other pedal installation structure is used as the right pedal. The pedals 4 of the two pedal installation structures are arranged opposite to each other. The two slide rails 1 are fixed on the left side wall and the right side wall of a boat 01, respectively.

Further, in order to facilitate the teeth 51 each to be disengaged from a corresponding one of the tooth grooves 11 and then engaged in an adjacent one of the tooth grooves 11 when the pull rod 2 or the pedal 4 is pulled, one side wall of the tooth groove 11 is defined as a first inclined surface 111 that is flared, and one side surface of the tooth 51 is defined as a second inclined surface 511. The first inclined surface 111 is configured to be in close contact with the second inclined surface 511. When the pull rod 2 or the pedal 4 is pulled, the first inclined surface 111 of the tooth groove 11 exerts a reaction force on the second inclined surface 511 of the tooth 51, so that the tooth 51 is pushed upward to be to be disengaged from one of the tooth grooves 11 and then engaged in an adjacent one of the tooth grooves 11. Another side wall of the tooth groove 11 is defined as a blocking surface 112. In this embodiment, the blocking surface 112 is a vertical surface, but not limited to this. The blocking surface 112 is opposite to the first inclined surface 111. Through the blocking surface 112, the pawl 5 is not easy to move in the first direction. The slider 3 can be moved on the slide rail 1 in the first direction only by pushing the first end of the pull rod 2.

Furthermore, in order to facilitate the second end of the pull rod 2 to push up the pawl 5, the second end of the pull rod 2 is formed with an inclined top surface 21. The inclined top surface 21 is attached to an inner side surface 52 of the pawl 5.

Further, in order to facilitate the falling of the pawl 5 and prevent the pawl 5 from moving in the first direction, the present invention further includes a pivot shaft 6 and a torsion spring 7. The torsion spring 7 is sleeved on the pivot shaft 6. The pivot shaft 6 passes through one end of the slider 3 and the pawl 5. One end of the torsion spring 7 is connected to the slider 3, and the other end of the torsion spring 7 is connected to the pawl 5. When the pull rod 2 is pushed, the second end of the pull rod 2 pushes up the pawl 5, and the torsion spring 7 is elastically deformed. When the pull rod 2 is released, the torsion spring 7 is elastically restored, and the pawl 5 falls.

In order to facilitate the installation of the pedal 4, the slider 3 is provided with a pedal seat 31. The middle portion of the pedal seat 31 is provided with a shaft 32. The pedal 4 is insertedly connected to the shaft 32.

In order to prevent the pull rod 2 from being pulled away from the slider 3 by mistake, the pull rod 2 has a raised block 23 close to the second end of the pull rod 2. The raised block 23 plays the role of the pull rod 2 to push and pull the pedal seat 31. A downward bent portion 53 is formed on one side of the pawl 5 away from the teeth 51. The raised block 23 is located between the outer side wall of the pedal seat 31 and the downward bent portion 53, so that the raised block 23 is confined by the outer side wall of the pedal seat 31 and the downward bent portion 53.

Further, in order to prevent the pull rod 2 from being lifted, a press block 12 is detachably connected to one side of the slide rail 1 close to the stern of the boat. The pull rod 2 is arranged below the press block 12.

In the first embodiment, the lower end of a rudder wheel 8 is insertedly connected to the shaft 32. The rudder wheel 8 is located between the pedal 4 and the pedal seat 31. In this embodiment, the pedal 4 is provided with a first screw 021. A sleeve 04 is sleeved on the first screw 021. The sleeve 04 is located between the first screw 021 and the pedal 4, so as to prevent the pedal 4 from being damaged during the locking process of the first screw 021 and to ensure that the pedal 4 and the rudder wheel 8 can rotate relative to the pedal seat 31 reliably. A nut 03 is provided in the shaft 32. The distal end of the first screw 021 is screwed to the nut 03.

The pedal 4 is detachably connected to the rudder wheel 8. In the first embodiment, the pedal 4 is detachably connected to the rudder wheel 8 through the cooperation of a protrusion 05 and a groove 06. The protrusion 05 may be disposed on the pedal 4. The groove 06 may be disposed on the rudder wheel 8. The number of the protrusions 05 and the grooves 06 is two. The upper end of the rudder wheel 8 is formed with a first rope-winding chamber 81. The pedal seat 31 is formed with a second rope-winding chamber 311. The shaft 32 is located in the middle of the second rope-winding chamber 311. One end of a rudder connecting rope 9 is connected to one end of the slide rail 1 away from the pull rod 2. The rudder connecting rope 9 is wound in the second rope-winding chamber 311 and the first rope-winding chamber 81 in sequence. The other end of the rudder connecting rope 9 is connected to a rudder 011 of the boat 01. Through the upper or lower end of the pedal 4, the rudder connecting rope 9 can pull the rudder 011 to swing, so that the boat 01 moves to control the direction of the boat, but does not provide power.

In the first embodiment, in order to facilitate the regular winding of the rudder connecting rope 9, reduce friction and reduce the wear of the rudder connecting rope 9, a rotating wheel 82 for winding the rudder connecting rope 9 is provided in the first rope-winding chamber 81. In the embodiment, the rotating wheel 82 is locked in the first rope-winding chamber 81 by a second screw 022. The first rope-winding chamber 81 is provided with a plurality of spaced restricting plates 811 extending outwardly. The restricting plates 811 surround the rotating wheel 82. The restricting plates 811 and the rotating wheel 82 are spaced apart. The restricting plates 811 are configured to prevent the rudder connecting rope 9 from coming out of the rotating wheel 82. Further, the second rope-winding chamber 311 may be provided with a plurality of through holes 312 for the rudder connecting rope 9 to pass through.

Further, in the first embodiment, the present invention further includes an elastic rope 10. One end of the elastic rope 10 is connected to the upper end of the rudder wheel 8. The other end of the elastic rope 10 is connected to the slider 3. When the driver steps on the upper or lower end of the pedal 4, the elastic rope 10 is deformed. When the driver's foot is moved away from the pedal 4, the rudder wheel 8 is returned, the pedal 4 is returned, and the rudder 011 is returned, which improves the convenience of use of the present invention.

Figure 6:
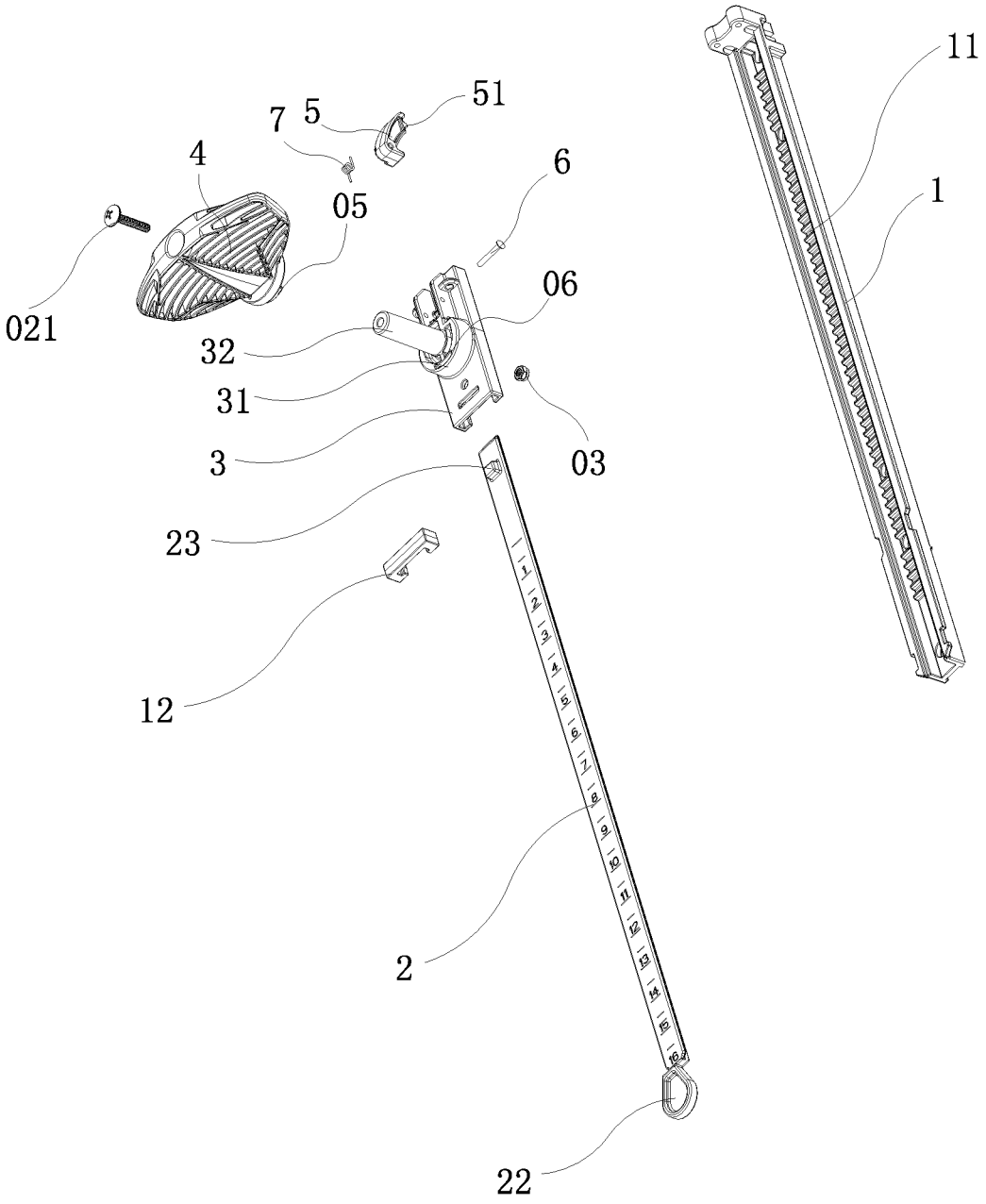
FIG. 6 is a partial exploded view of a second embodiment of the present invention.

FIG. 6 illustrates a second embodiment applied to a kayak 01 without the rudder 011, wherein the foot position can be effectively located and the pedal 4 does not rotate. The pedal 4 is fixed to the pedal seat 31 through the cooperation of a protrusion 05 and a groove 06. The number of the protrusions 05 and the grooves 06 is two.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A pedal installation structure of a boat, comprising a slide rail, a pull rod, a slider and a pedal, the slide rail having a plurality of spaced tooth grooves thereon, the pedal being installed on the slider, the slider being slidably installed on the slide rail, the pull rod being installed between the slider and the slide rail, one end of the slider being provided with a rotatable pawl, a lower surface of the pawl being provided with a plurality of spaced teeth, wherein when a first end of the pull rod is pushed, an opposing second end of the pull rod pushes up the pawl, so that the teeth are disengaged from the tooth grooves for the slider to move on the slide rail in a first direction; when the pull rod is released, the pawl falls so that the teeth are engaged in the corresponding tooth grooves; when the pull rod or the pedal is pulled, the slider is driven to move on the slide rail in a second direction opposite to the first direction, the teeth are each disengaged from a corresponding one of the tooth grooves and then engaged in an adjacent one of the tooth grooves.

2. The pedal installation structure of the boat as claimed in claim 1, wherein one side wall of each tooth groove is defined as a first inclined surface that is flared, one side surface of each tooth is defined as a second inclined surface, the first inclined surface is configured to be in close contact with the second inclined surface, another side wall of each tooth groove is defined as a blocking surface, and the blocking surface is opposite to the first inclined surface.

3. The pedal installation structure of the boat as claimed in claim 2, wherein the slider is provided with a pedal seat, a middle portion of the pedal seat is provided with a shaft, a lower end of a rudder wheel is insertedly connected to the shaft, the pedal is insertedly connected to the shaft, the rudder wheel is located between the pedal and the pedal seat, the pedal is detachably connected to the rudder wheel, an upper end of the rudder wheel is formed with a first rope-winding chamber, the pedal seat is formed with a second rope-winding chamber, the shaft is located in the middle of the second rope-winding chamber, one end of a rudder connecting rope is connected to one end of the slide rail away from the pull rod, the rudder connecting rope is wound in the second rope-winding chamber and the first rope-winding chamber in sequence, and another end of the rudder connecting rope is connected to a rudder of the boat.

4. The pedal installation structure of the boat as claimed in claim 3, wherein a rotating wheel for winding the rudder connecting rope is provided in the first rope-winding chamber, the first rope-winding chamber is provided with a plurality of spaced restricting plates extending outwardly, the restricting plates surround the rotating wheel, and the restricting plates are spaced apart from the rotating wheel.

5. The pedal installation structure of the boat as claimed in claim 3, further comprising an elastic rope, one end of the elastic rope being connected to the upper end of the rudder wheel, and another end of the elastic rope is connected to the slider.

6. The pedal installation structure of the boat as claimed in claim 3, wherein the pedal is connected to the rudder wheel through cooperation of a protrusion and a groove.

7. The pedal installation structure of the boat as claimed in claim 2, wherein the slider is provided with a pedal seat, a middle portion of the pedal seat is provided with a shaft, the pedal is insertedly connected to the shaft, the pull rod has a raised block close to the second end of the pull rod, a downward bent portion is formed on one side of the pawl away from the teeth, and the raised block is located between an outer side wall of the pedal seat and the downward bent portion.

8. The pedal installation structure of the boat as claimed in claim 1, wherein the second end of the pull rod is formed with an inclined top surface, and the inclined top surface is attached to an inner side surface of the pawl.

9. The pedal installation structure of the boat as claimed in claim 8, wherein the slider is provided with a pedal seat, a middle portion of the pedal seat is provided with a shaft, a lower end of a rudder wheel is insertedly connected to the shaft, the pedal is insertedly connected to the shaft, the rudder wheel is located between the pedal and the pedal seat, the pedal is detachably connected to the rudder wheel, an upper end of the rudder wheel is formed with a first rope-winding chamber, the pedal seat is formed with a second rope-winding chamber, the shaft is located in the middle of the second rope-winding chamber, one end of a rudder connecting rope is connected to one end of the slide rail away from the pull rod, the rudder connecting rope is wound in the second rope-winding chamber and the first rope-winding chamber in sequence, and another end of the rudder connecting rope is connected to a rudder of the boat.

10. The pedal installation structure of the boat as claimed in claim 9, wherein a rotating wheel for winding the rudder connecting rope is provided in the first rope-winding chamber, the first rope-winding chamber is provided with a plurality of spaced restricting plates extending outwardly, the restricting plates surround the rotating wheel, and the restricting plates are spaced apart from the rotating wheel.

11. The pedal installation structure of the boat as claimed in claim 9, further comprising an elastic rope, one end of the elastic rope being connected to the upper end of the rudder wheel, and another end of the elastic rope is connected to the slider.

12. The pedal installation structure of the boat as claimed in claim 9, wherein the pedal is connected to the rudder wheel through cooperation of a protrusion and a groove.

13. The pedal installation structure of the boat as claimed in claim 8, wherein the slider is provided with a pedal seat, a middle portion of the pedal seat is provided with a shaft, the pedal is insertedly connected to the shaft, the pull rod has a raised block close to the second end of the pull rod, a downward bent portion is formed on one side of the pawl away from the teeth, and the raised block is located between an outer side wall of the pedal seat and the downward bent portion.

14. The pedal installation structure of the boat as claimed in claim 1, further comprising a pivot shaft and a torsion spring, the torsion spring being sleeved on the pivot shaft, the pivot shaft passing through the end of the slider and the pawl, one end of the torsion spring being connected to the slider, another end of the torsion spring being connected to the pawl, wherein when the pull rod is pushed, the second end of the pull rod pushes up the pawl, and the torsion spring is elastically deformed; wherein when the pull rod is released, the torsion spring is elastically restored and the pawl falls.

15. The pedal installation structure of the boat as claimed in claim 14, wherein the slider is provided with a pedal seat, a middle portion of the pedal seat is provided with a shaft, a lower end of a rudder wheel is insertedly connected to the shaft, the pedal is insertedly connected to the shaft, the rudder wheel is located between the pedal and the pedal seat, the pedal is detachably connected to the rudder wheel, an upper end of the rudder wheel is formed with a first rope-winding chamber, the pedal seat is formed with a second rope-winding chamber, the shaft is located in the middle of the second rope-winding chamber, one end of a rudder connecting rope is connected to one end of the slide rail away from the pull rod, the rudder connecting rope is wound in the second rope-winding chamber and the first rope-winding chamber in sequence, and another end of the rudder connecting rope is connected to a rudder of the boat.

16. The pedal installation structure of the boat as claimed in claim 15, wherein a rotating wheel for winding the rudder connecting rope is provided in the first rope-winding chamber, the first rope-winding chamber is provided with a plurality of spaced restricting plates extending outwardly, the restricting plates surround the rotating wheel, and the restricting plates are spaced apart from the rotating wheel.

17. The pedal installation structure of the boat as claimed in claim 15, further comprising an elastic rope, one end of the elastic rope being connected to the upper end of the rudder wheel, and another end of the elastic rope is connected to the slider.

18. The pedal installation structure of the boat as claimed in claim 15, wherein the pedal is connected to the rudder wheel through cooperation of a protrusion and a groove.

19. The pedal installation structure of the boat as claimed in claim 14, wherein the slider is provided with a pedal seat, a middle portion of the pedal seat is provided with a shaft, the pedal is insertedly connected to the shaft, the pull rod has a raised block close to the second end of the pull rod, a downward bent portion is formed on one side of the pawl away from the teeth, and the raised block is located between an outer side wall of the pedal seat and the downward bent portion.

20. The pedal installation structure of the boat as claimed in claim 1, wherein the slider is provided with a pedal seat, a middle portion of the pedal seat is provided with a shaft, a lower end of a rudder wheel is insertedly connected to the shaft, the pedal is insertedly connected to the shaft, the rudder wheel is located between the pedal and the pedal seat, the pedal is detachably connected to the rudder wheel, an upper end of the rudder wheel is formed with a first rope-winding chamber, the pedal seat is formed with a second rope-winding chamber, the shaft is located in the middle of the second rope-winding chamber, one end of a rudder connecting rope is connected to one end of the slide rail away from the pull rod, the rudder connecting rope is wound in the second rope-winding chamber and the first rope-winding chamber in sequence, and another end of the rudder connecting rope is connected to a rudder of the boat.

* * * * *